US006193818B1

(12) United States Patent
Legresy et al.

(10) Patent No.: US 6,193,818 B1
(45) Date of Patent: Feb. 27, 2001

(54) METHOD FOR MAKING THIN, HIGH-STRENGTH, HIGHLY FORMABLE ALUMINIUM ALLOY STRIPS

(75) Inventors: Jean-Marc Legresy, La Fleche; Herve Gehanno, Eybens; Martin Peter Schmidt, La Murette; Pierre Yves Menet, Colmar; Philippe Jarry, Grenoble, all of (FR)

(73) Assignee: Pechiney Rhenalu, Courbevoie (FR)

( * ) Notice: Subject to any disclaimer, the term of this patent is extended or adjusted under 35 U.S.C. 154(b) by 0 days.

(21) Appl. No.: 09/077,841

(22) PCT Filed: Dec. 9, 1996

(86) PCT No.: PCT/FR96/01956

§ 371 Date: Jun. 11, 1998

§ 102(e) Date: Jun. 11, 1998

(87) PCT Pub. No.: WO97/21508

PCT Pub. Date: Jun. 19, 1997

(30) Foreign Application Priority Data

Dec. 12, 1995 (FR) ..... 95 14881

(51) Int. Cl.[7] ..... C22C 21/02
(52) U.S. Cl. ..... 148/551; 148/552
(58) Field of Search ..... 148/551, 552; 420/549; 29/33 C; 164/476

(56) References Cited

U.S. PATENT DOCUMENTS

| | | | | |
|---|---|---|---|---|
| 4,126,486 | * | 11/1978 | Morris et al. | 148/552 |
| 5,286,315 | * | 2/1994 | Iwayama et al. | 148/538 |
| 5,503,689 | * | 4/1996 | Ward et al. | 148/549 |
| 5,571,347 | * | 11/1996 | Bergsma | 148/551 |
| 5,655,593 | * | 8/1997 | Wyah-Mair et al. | 164/476 |

FOREIGN PATENT DOCUMENTS

| | | | |
|---|---|---|---|
| 2291284 | * | 6/1976 | (FR) . |
| 62-207851 | * | 9/1987 | (JP) . |
| 95 14113A | * | 5/1995 | (WO) . |
| 95 27805 | * | 10/1995 | (WO) . |

OTHER PUBLICATIONS

*Patent Abstracts of Japan,* vol. 12, No. 70 (C–479) Mar. 4, 1988 & JP 62 207851 A (Sky Alum Co Ltd), Sep. 12, 1987.*

Hufnagel, W. "Aluminum–Taschenbuch", 1983, *Aluminum–Verlag,* Dusseldorf XP002011770 pp. 1043 and 1016.*

Jin et al., "Centerline Segregation in Twin–Roll–Cast Aluminum Alloy Slab", *Journal of Metals,* Jun. 1982, pp. 70–75.*

Derwent Abstracts #1995–041647. Japanese Patent No. 06322467 Nov. 22, 1994.*

* cited by examiner

*Primary Examiner*—Roy V. King
*Assistant Examiner*—Tima McGuthry-Banks
(74) *Attorney, Agent, or Firm*—Dennison, Scheiner, Schultz & Wakeman

(57) ABSTRACT

Process for forming an aluminum alloy strip, including the steps of a) obtaining an aluminum alloy consisting essentially of, by weight, 0.5 to 13% Si, 0 to 2% Mg, 0 to 2% Cu, 0 to 1% Mn, 0 to 2% Fe, other elements less than 0.5% each and less than 2% total, and remainder Al; and b) continuously casting the aluminum alloy between twin cooled rolls having a force applied thereto, to obtain a cast strip of thickness between 1.5 and 5 mm, and optionally cold rolling the cast strip. The force applied to the rolls is maintained below an amount represented by a straight line between a point A and a point B on a graph of specific applied force (y-axis) vs. cast width (x-axis), where point A is (1.5 mm, 750 tons/meter at cast width) and point B is (5 mm, 500 tons/meter of cast width).

6 Claims, 8 Drawing Sheets

Alloy A

Caption:
dot: sound microstructure
circle: unacceptable microstructure

Alloy B

CAPTION:
dot: sound microstructure
circle: unacceptable microstructure

Alloy C

CAPTION:
dot: sound microstructure
circle: unacceptable microstructure

Alloy D

CAPTION:
dot: sound microstructure
circle: unacceptable microstructure

Alloy E

CAPTION:
dot: sound microstructure
circle: unacceptable microstructure

METHOD FOR MAKING THIN, HIGH-STRENGTH, HIGHLY FORMABLE ALUMINIUM ALLOY STRIPS

FIELD OF THE INVENTION

The invention relates to a process for manufacturing strips less than 5 mm thick in aluminium alloys whose alloying elements are silicon and possibly magnesium, manganese and/or copper, by continuous casting between cooled twin rolls and, if required, cold rolling, these strips offering high mechanical resistance and good formability, intended for mechanical applications, in particular automotive body panel work.

DESCRIPTION OF RELATED ART

Strips in aluminium alloys intended for mechanical applications such as automotive body panel work are customarily produced by semi-continuous casting of plates, hot rolling and cold rolling, with a certain number of intermediate or final heat treatments.

Continuous casting processes may also be used, in particular continuous casting between cooled twin rolls, which offer the advantage of limiting and often avoiding the hot rolling operation, but their operation raises problems for alloys containing large quantities of alloying elements.

U.S. Pat. No. 4,126,486 by ALCAN therefore describes a process for the manufacture of strips in AlSi alloy (Si being between 4 and 15% by weight) with possible additions of Mg, Cu, Zn, Fe and/or Mn, obtained for example by continuous twin roll casting at a speed of >0.25 m/mn, of a strip whose thickness gauge is between 5 and 8 mm, followed by cold rolling at a reduction rate of more than 60% and annealing.

A cast structure is obtained having intermetallic compounds in rod form, which are converted into fine particles by cold rolling, which improves formability.

Japanese patent application JP 62-207851 by SKY ALUMINIUM relates to strips in AlSiMg alloy with Si lying between 0.4 and 2.5%, and Mg between 0.1 and 1.2% (by weight), having a fine intermetallic structure, obtained by continuous casting of a strip with a thickness of between 3 and 15 mm, followed by cold rolling, solution treatment and quenching. These strips may be used for automotive body panel work and other mechanical applications such as air conditioners or gasoline tanks.

This range of alloys comes under the conventional compositions of aluminium alloys in the 6000 series which can be obtained by conventional casting, and it does not make use of the hardening potential of copper and silicon, as their formability is limited by the presence of rough silicon phases which restricts applications thereof.

In general, the production of alloys having a high content of alloying elements by continuous roll casting raises problems, since the presence of intermetallic phases may, at the time of casting, lead to a microstructure that does is unfit for subsequent working. If it is required to obtain strips in aluminium alloys, even with a low alloy element content, that provide both high mechanical resistance and good formability, publications on the subject recommend that substantial force is applied between the rolls in order to obtain a segregate-free microstructure.

P. M. THOMAS and P. G. GROCOK from the DAVY INTERNATIONAL company in their report on "High speed thin strip casting comes of age" presented at the ALUMITECH Congress in Atlanta (USA) on Oct. 26–28, 1994, indicated in this respect that considerable forces of between 0.5 to 1 t per mm width of strip need to be applied to the rolls in order to obtain pure or low-alloy aluminium, which implies the use of barrel-shaped rolls.

According to these authors, the applied forces need to be higher, the thinner the thickness of the cast strip. The effect of applied force on the formation of central segregation is summarized in the article in the form of a diagram reproduced in FIG. 1, showing the limits of segregation onset in relation to the force applied and the thickness of the strip. According to the authors, this diagram shows that it is possible to obtain a microstructure free of centre line microstructural defects under all conditions except under relatively low applied forces. With narrow thicknesses, greater specific forces need to be applied so that the structure remains free of segregates.

The paper presented by B. TARAGLIO and C. ROMANOWSKI from the HUNTER ENGINEERING company on "Thin-gauge/High-speed roll casting technology for foil production" at the AIME/TMS Light Metals 95 Congress, indicated that the power of the rolling mill used for continuous roll casting is 3000 t. This value underlines the necessity of using high forces during continuous roll casting. It is evident that a reduction in this force would be of great interest, as it would allow lighter and therefore cheaper equipment to be built.

It is known to men of the art, as shown by the above article, that the operating point of a continuous roll casting machine is determined by three variables: the force exerted by the rolls on the strip (expressed in tonnes per metre of strip width), the thickness of the strip on exiting the roll mill (in mm) and casting speed (in m/mn). Any two of these variables may be adjusted independently and, for each operating point thus defined, it is the quality of the product obtained and the efficiency of the machine which determine the industrial advantage of the process.

To summarize, according to the state of the art, an operating point must be sought in the area of strong force, all the more so when the alloy has a high alloying content. Also, it is ascertained that up until now, no such high content alloys have been manufactured by continuous roll casting. This is shown for example by the list of alloys given in table 1 of the previously mentioned article by B. TARAGLIO et al., which lists those which can be cast using the casting machine he describes.

SUMMARY OF THE INVENTION

It came to the notice of the inventors that, unlike the teaching of the prior art, the use of an operating point corresponding to a low level of force between the rolls, led in surprising manner to an improvement in the microstructural quality of the cast strips compared with strips that were cast using higher forces, and allowed thin strips to be obtained in alloys containing silicon, magnesium, manganese and/or copper, in particular AlSiMg and AlSiMgCu alloys which up until now could be not be obtained by continuous casting, and which moreover offered strong mechanical properties and good formability The object of the invention is therefore a process for the manufacture of strips in aluminium alloy having high mechanical resistance and good formability, entailing:

the preparation of an aluminium alloy containing (by weight) from 0.5 to 13% of Si, from 0 to 2% Mg, and/or from 0 to 1% manganese, and/or from 0 to 2% Cu, and/or from 0 to 2% Fe, the other elements being less than 0.5% each and 2% overall.

continuous twin roll casting of this alloy between 2 cooled rolls to obtain a strip whose thickness lies between 1.5 and 5 mm, possible cold rolling of this strip to a thickness of less than 2 mm, process in which the operating point, in a diagram whose X axis is the thickness of the strip (in mm) and whose Y-axis is the specific force applied to the rolls (in t per metre of cast strip width), is located below the straight line AB, preferably below the straight line $A^1B^1$, A, B, $A^1$ and $B^1$ having the co-ordinates:

| | | | | | |
|---|---|---|---|---|---|
| A | 1.5 mm | 750 t/m | $A^1$ | 1.5 mm | 700 t/m |
| B | 5 mm | 500 t/m | $B^1$ | 5 mm | 300 t/m |

The process may possibly also comprise annealing of the cast strip, before rolling, at a temperature of between 420 and 600° C. depending upon the alloy composition, and also heat treatment of the rolled strip by solution treatment at between 420 and 600° C., quenching and artificial ageing at a temperature of <300° C.

The invention preferably applies to alloys having a (weight %) composition of:

Si: 2.6–13; Mg: 1.4–2; Cu <2; Fe <0.4 (and, preferably, <0.25); Mn<0.5.

DESCRIPTION OF THE PREFERRED EMBODIMENTS

Figure 1:
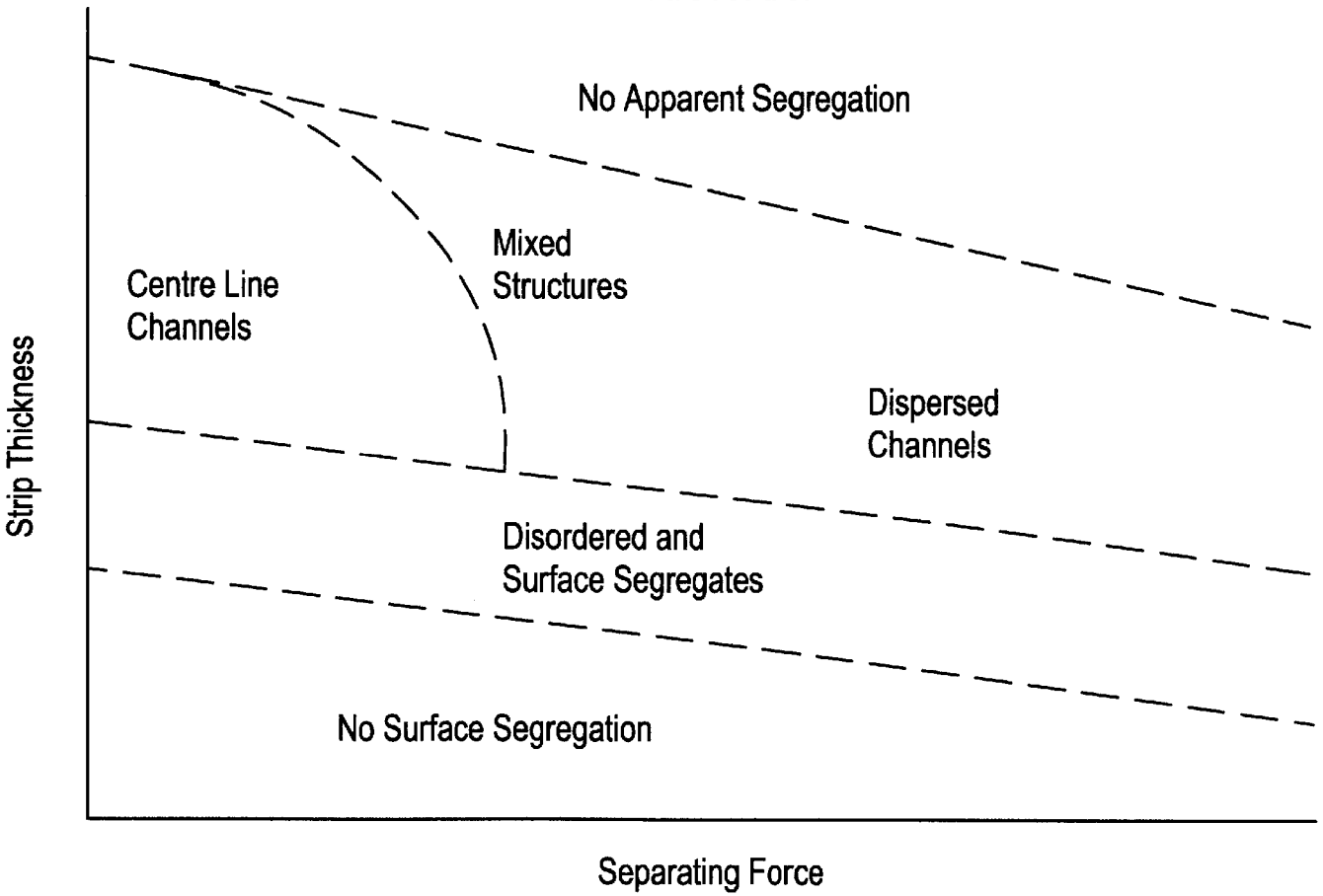
FIG. 1 PRIOR ART
FIG. 1 shows a non-dimensioned diagram whose X-axis is the force applied and whose Y-axis represents strip thickness, the different areas corresponding to apparent microstructural defects, in particular segregates. This diagram is taken from the article by P. M. THOMAS et al, previously mentioned and therefore belongs to the prior art.
Figure 2:
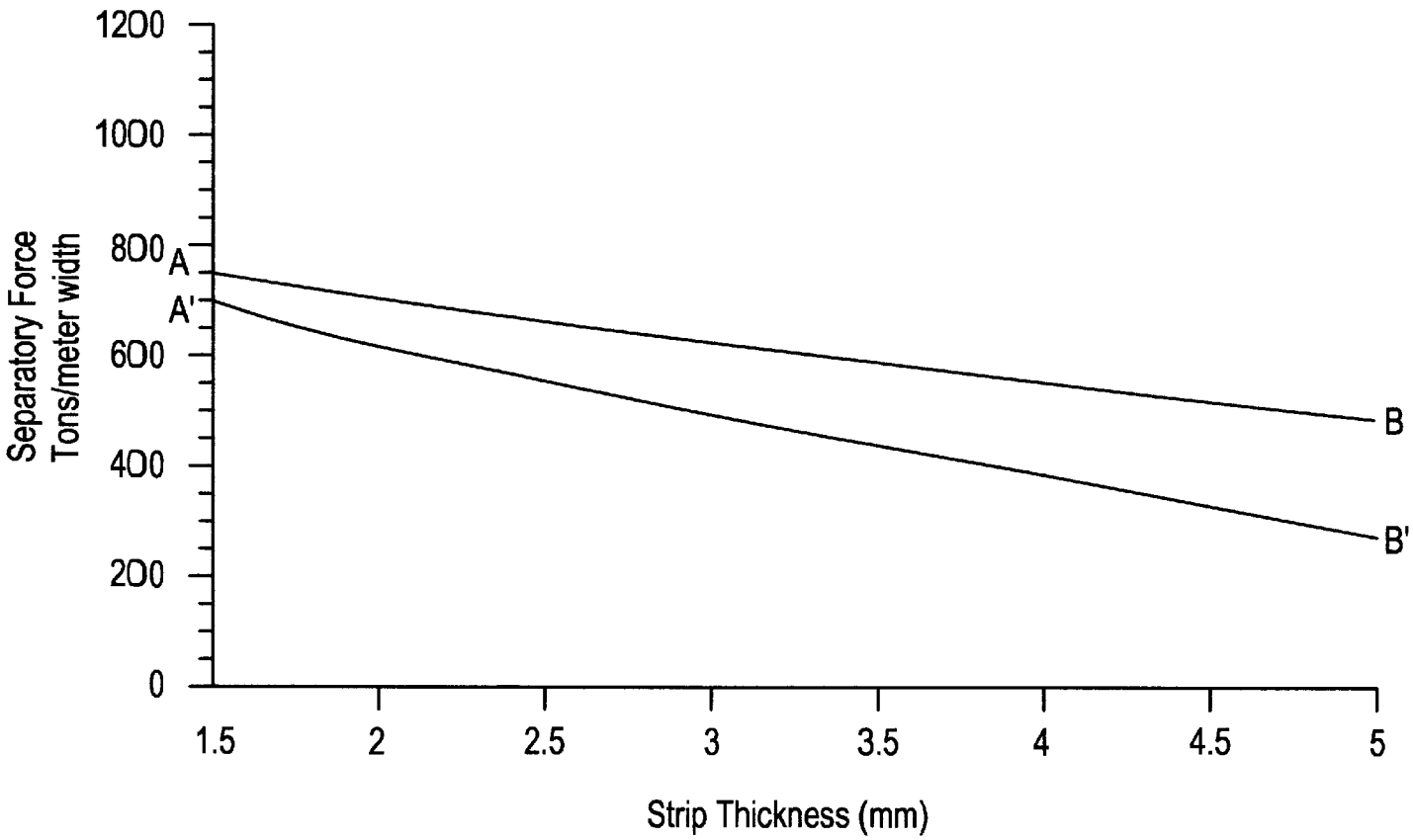
FIG. 2 is a diagram showing the operating zone of the invention, in which the X-axis represents the thickness of the cast strip and the Y-axis plots the specific force applied to the rolls.

The aluminium alloy used in the process of the invention contains 0.5 to 13% silicon. Over and above 13%, the formation of silicon phases is observed which are detrimental to formability. Below 0.5% the hardening provided by Si is insufficient to obtain adequate mechanical properties for the applications under consideration such as automotive body panel work.

The silicon may be combined with magnesium to allow precipitation of $Mg_2Si$ metastable hardening phases. Mg contents that are too high, over 2%, lead to segregates, which increase with the increase in force applied during casting.

The adjunction of copper or iron brings an improvement in mechanical resistance but, over and above 2%, strip ductility, and therefore formability, is too much reduced. The adjunction of manganese provides better control over grain size.

The preparation of alloys with a high alloying content must be carefully controlled since high levels of alloying elements lead to a great number of intermetallic phases which may group together to form segregation on solidification, which has a detrimental effect on the mechanical properties of the strips, more especially on their formability. It is the reason why the control of parameters unconnected with casting, such as thickness and applied force must be both permanent and precise.

The continuous casting of these alloys is made by twin roll casting between 2 cooled rolls. Casting machines of this type have existed for many years, for example the "3C" casting machines sold by PECHINEY RHENALU, and they have recently been adapted to cast strips less than 5 mm thick.

To avoid the formation of intermetallic phase segregration in the cast strip, which has a detrimental effect on mechanical properties, and especially on formability, the applicant found, in surprising manner, that for a given width of cast strip, the force applied to the rolls needed to be limited during casting (sometimes called "separating force" as it is the force which opposes the separation of the rolls from each other) within a particular area of the force/thickness diagram.

Unlike the recommendations of the prior art, the force must be limited increasingly with the increase in the alloying element content of the alloy, in particular the magnesium content, when the risk of formation of harmful segregates is at its highest.

Specific force cannot fall below 100 t/m otherwise the strip would no longer be driven forward and the surface condition would not be satisfactory. It is always below 750 t/m and must be maintained below the straight line AB, preferably below the straight line $A^11B^1$, in order to obtain a no-defect microstructure such as the one shown in FIG. 3.

For alloys with structural hardening, the rolled strip undergoes heat treatment which conventionally comprises solution treatment at a temperature that is slightly below starting melting point, quenching and maturing at ambient temperature or artificial ageing at a temperature of below 300° C.

EXAMPLES 5 alloys were produced, referenced from A to E, having the following composition:

| Alloy | Si | Mg | Cu | Fe | Mn |
|---|---|---|---|---|---|
| A | 7.05 | 0.56 | 0.12 | 0.21 | 0.03 |
| B | 7.02 | 0.60 | 0.002 | 0.14 | 0.02 |
| C | 4.8 | 1.42 | 1.80 | 0.18 | 0.04 |
| D | 11.9 | 0.50 | 0.19 | 0.29 | 0.33 |
| E | 2.0 | 1.83 | 0.92 | 0.22 | 0.02 |

Refining treatment was conducted using an aluminium-titanium-boron alloy of AT5B type added to the liquid metal in the production furnace.

The 5 alloys were cast between 2 hooped rolls in special steel, water cooled on the inside, on a "3C" casting machine made by PECHINEY RHENALU, to obtain strips with a width of 1.5 m, at different thickness and force values. The temperature on exiting the casting machine was between 220 and 350° C.

Figure 3:
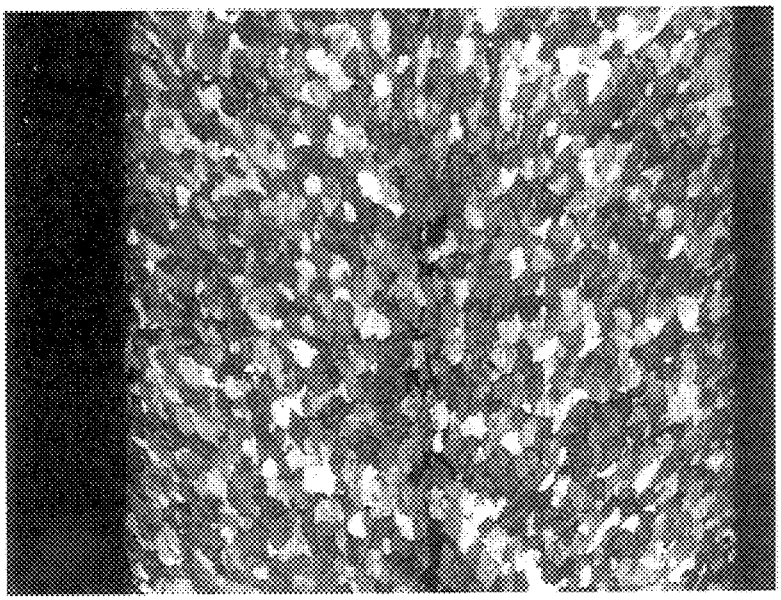
FIGS. 3 and 4 are section micrographs of cast strip, respectively showing a defect-free microstructure with fine, homogeneous intermetallic dispersion and a microstructure with segregrates unfit for subsequent working.
Figure 4:
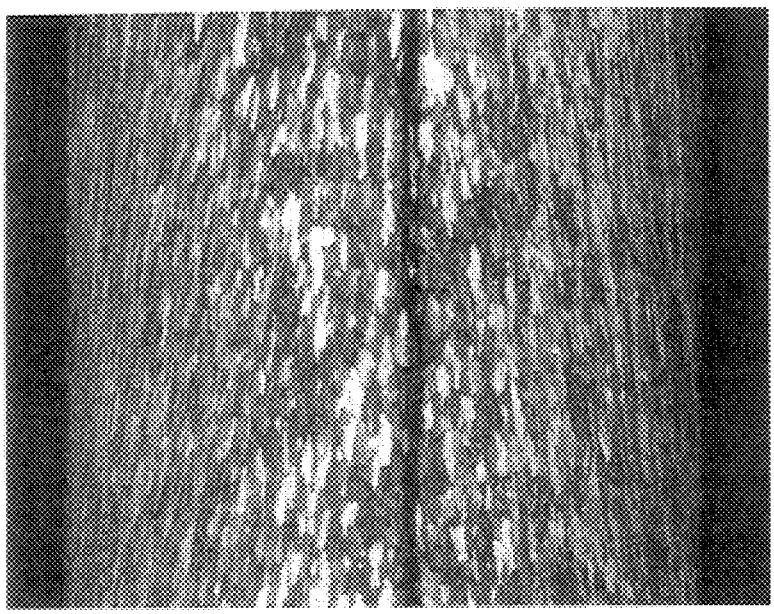

The microstructure of the cast strips was examined, FIG. 3 showing an example of a defect-free microstructure with fine intermetallic particles dispersed in homogeneous manner, and FIG. 4 showing a faulty microstructure with intermetallic segregates in the form of long channels oriented in the direction of the cast, making it unfit for any subsequent working.

The cast strips were subsequently homogenized at 540° C. for 8 h, then cold rolled to 1 mm, given solution treatment at a temperature of 540° C. in a through furnace, quenched and artificially aged at 180° C. for times varying from 30 mn to 8 h.

Alloy A

Figure 5:
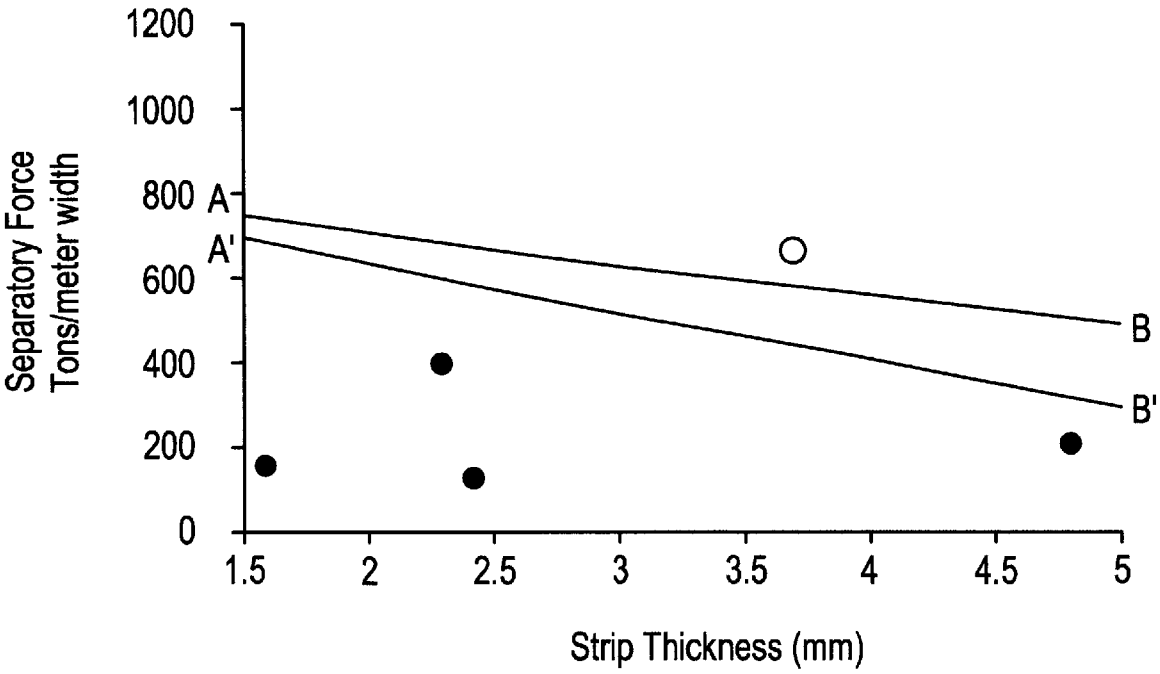
FIGS. 5 to 9 respectively show, for 5 different alloys, the points which represent casting parameters for the different tests conducted, in a thickness-force diagram.

The results of the 5 tests conducted with this alloy with different thickness and with different forces applied to the rolls, are given in the following table and are plotted in the graph in FIG. 5:

| Test | 1 | 2 | 3 | 4 | 5 |
|---|---|---|---|---|---|
| Cast thickness (mm) | 2.4 | 1.6 | 4.8 | 2.3 | 3.7 |
| Force (t/m) | 132 | 158 | 213 | 403 | 685 |

On the strip that was rolled and given heat treatment in solution, quenched and artificially aged, corresponding to test n° 3, that is to say a cast thickness of 4.8 mm, a casting speed of 2.1 m/mn and a force of 213 t/m, measurements were taken of yield strength $R_{0,2}$ at 0.2% of plastic strain, ultimate stress Rm, and strain level n measured at between 3 and 4% strain:

| |
|---|
| $R_{0.2}$ = 240 MPa |
| Rm = 315 MPa |
| n = 0.273 |

Alloy B

The results of the 14 tests were as follows:

| Test | Thickness mm | Force t/m |
|---|---|---|
| 1 | 2.40 | 483 |
| 2 | 2.55 | 533 |
| 3 | 2.62 | 583 |
| 4 | 2.80 | 450 |
| 5 | 3.00 | 383 |
| 6 | 3.10 | 473 |
| 7 | 3.25 | 560 |
| 8 | 3.36 | 466 |
| 9 | 3.55 | 450 |
| 10 | 3.65 | 473 |
| 11 | 3.75 | 360 |
| 12 | 3.90 | 366 |
| 13 | 3.98 | 326 |
| 14 | 4.06 | 633 |

Figure 6:
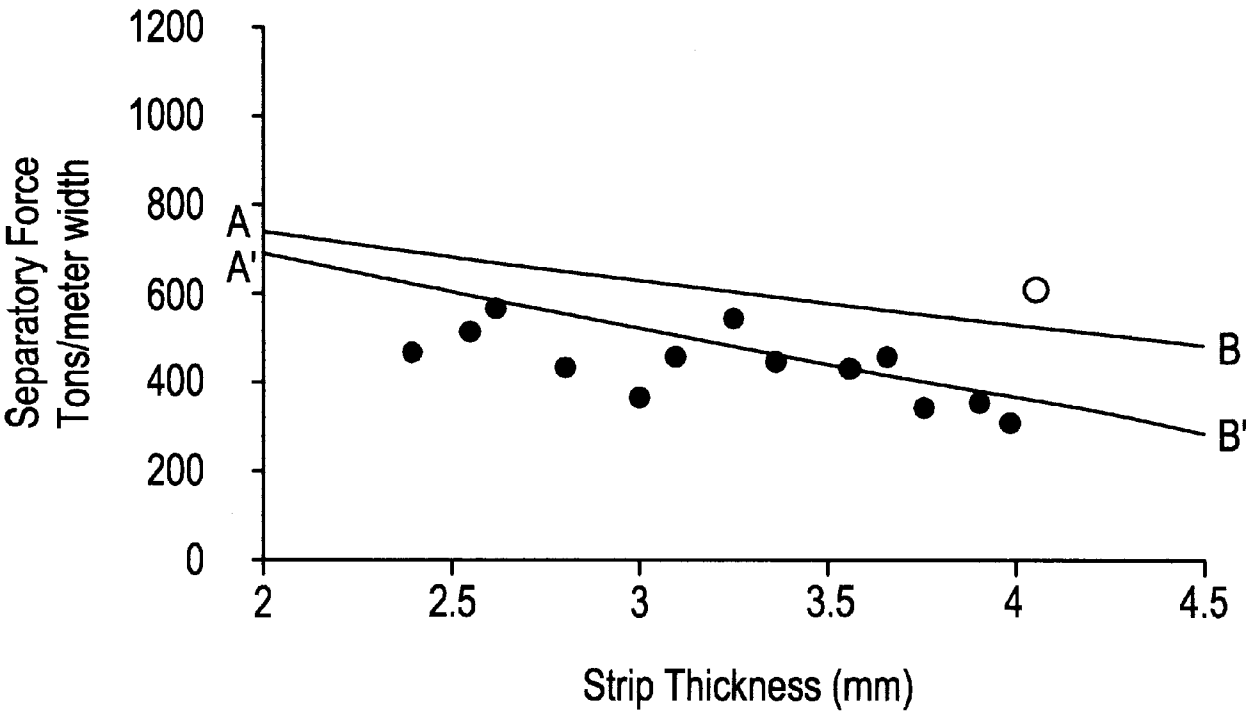

They are illustrated in the graph in FIG. 6. The microstructure is defect-free in all cases, except for test n° 14.

Alloy C

The 3 tests on this alloy gave the following results:

| Test | 1 | 2 | 3 |
|---|---|---|---|
| Cast thickness (mm) | 2.51 | 4.14 | 3.80 |
| Force (t/m) | 240 | 489 | 632 |
| Microstructure | sound | sound | unfit |

Figure 7:
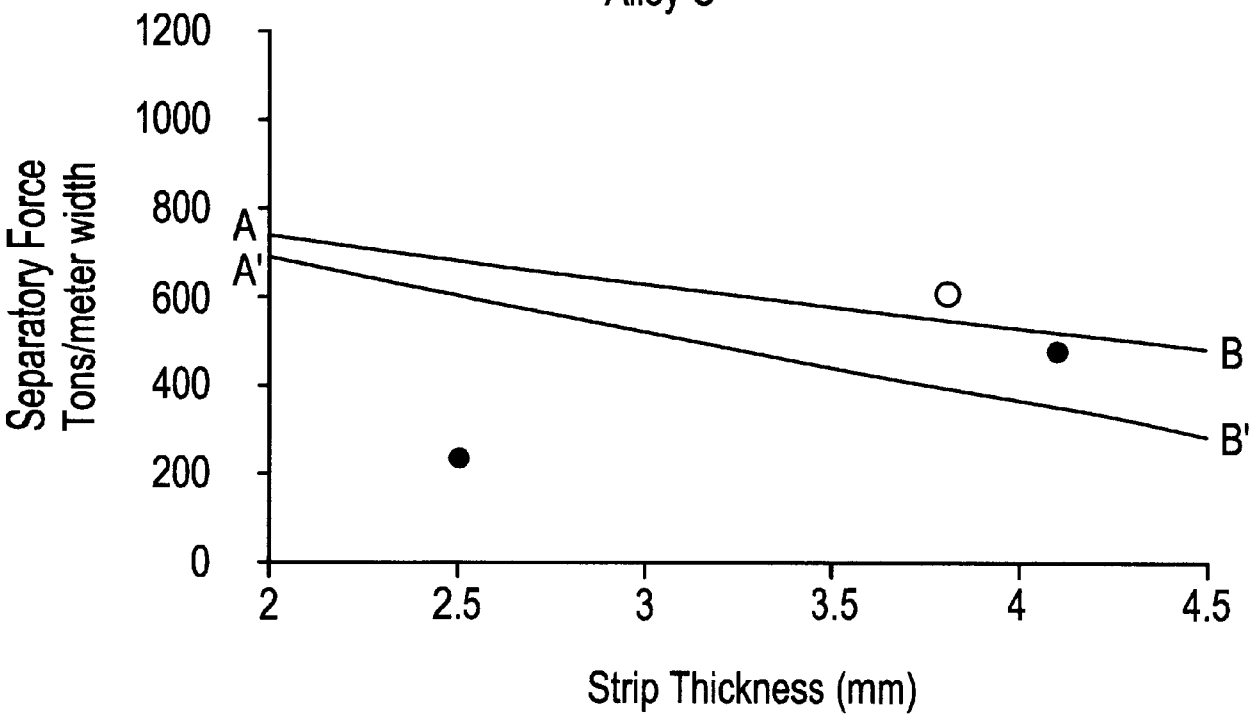

These results are plotted in the graph in FIG. 7. The mechanical properties of the rolled, heat treated strip derived from cast n° 2 (cast thickness: 4.14 mm, speed: 1.78 m/mn and force: 489 t/m) are:

| |
|---|
| $R_{0.2}$ = 275 MPa |
| Rm = 345 MPa |
| n = 0.286 |

Alloy D

The results of the 6 cast tests were as follows:

| Test | 1 | 2 | 3 | 4 | 5 | 6 |
|---|---|---|---|---|---|---|
| Cast thickness (mm) | 4.3 | 1.8 | 1.9 | 3.6 | 2.3 | 4.15 |
| Force (t/m) | 132 | 198 | 286 | 456 | 763 | 863 |
| Micro-structure | sound | sound | sound | sound | unfit | unfit |

Figure 8:
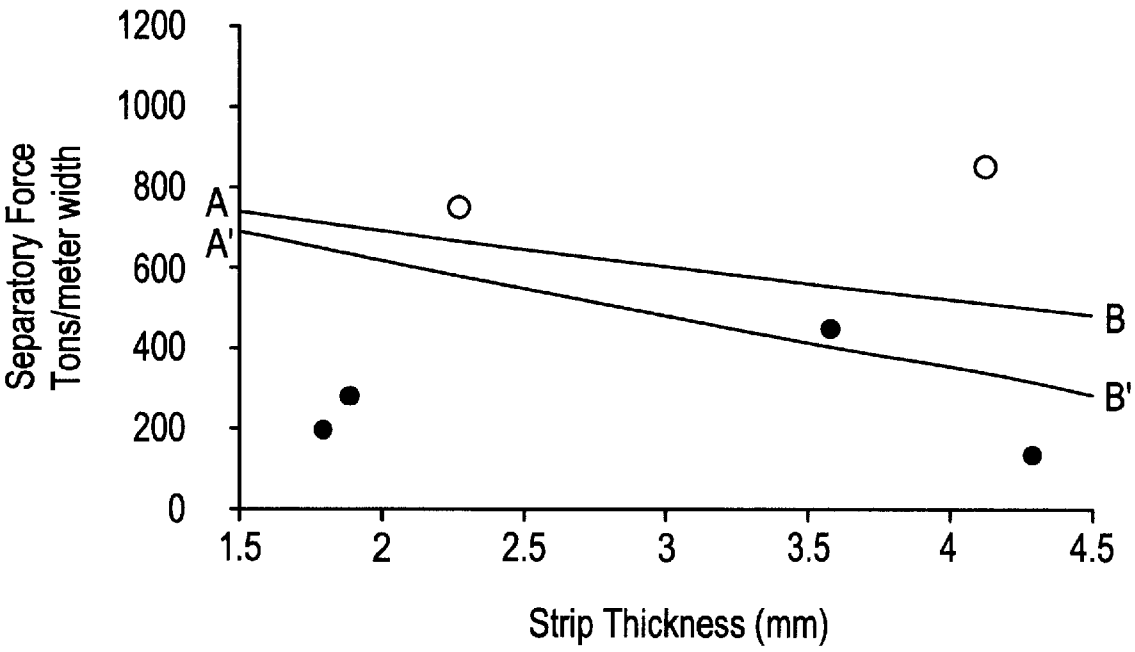

These results are plotted in the graph in FIG. 8. On the rolled, heat treated strips derived from tests n° 1 and 3, the following mechanical characteristics were measured:

| | | | |
|---|---|---|---|
| n °1 | $R_{0.2}$ = 168 MPa | Rm = 356 MPa | n = 0.263 |
| n °3 | $R_{0.2}$ = 179 MPa | Rm = 345 MPa | n = 0.289 |

Alloy E

The results of the 3 tests were as follows:

| Test | 1 | 2 | 3 |
|---|---|---|---|
| Cast thickness (mm) | 3.23 | 4.30 | 2.15 |
| Force (t/m) | 207 | 456 | 603 |
| Microstructure | sound | sound | sound |

Figure 9:
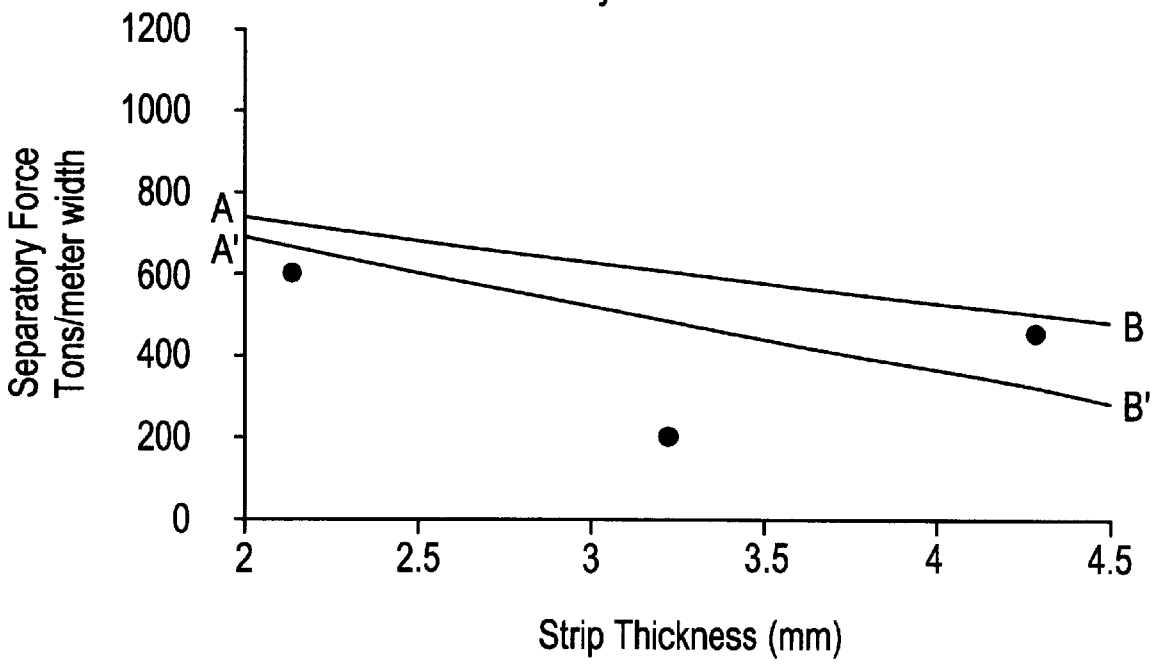

These results are plotted in the graph in FIG. 9. On the rolled, heat treated strip, corresponding to cast n° 1 (thickness 3.23 mm, speed: 3.1 m/m:, force 207 t/m); the following mechanical properties were measured:

| | | |
|---|---|---|
| $R_{0.2}$ = 210 MPa | Rm = 320 MPa | n = 0.299 |

What is claimed is:

1. Process for forming an aluminum alloy strip, comprising the steps of:

a) obtaining an aluminum alloy consisting essentially of, by weight, 0.5 to 13% Si, 0 to 2% Mg, 0 to 2% Cu, 0 to 1% Mn, 0 to 2% Fe, other elements less than 0.5% each and less than 2% total, and remainder Al; and b) continuously casting said aluminum alloy between twin cooled rolls having a force applied thereto, to obtain a cast strip of thickness between 1.5 and 5 mm, and optionally cold rolling the cast strip;

wherein the force applied to the rolls is maintained below an amount represented by a straight line between a point A and a point B on a graph of specific applied force (y-axis) vs. cast width (x-axis), where point A is (1.5 mm, 750 tons/meter of cast width) and point B is (5 mm, 500 tons/meter of cast width).

2. The process of claim 1, wherein the force applied is maintained below an amount represented by a straight line between a point A' and a point B' on said graph, wherein A' is (1.5 mm, 700 tons/meter of cast width) and B' is (5 mm, 300 tons/meter of cast width).

3. The process of claim 1, wherein the alloy contains Si>2.6% and Mg>14%.

4. The process of claim 1, wherein prior to said optional cold rolling, the cast strip is subjected to an homogenizing annealing at a temperature between 420 and 600° C.

5. The process of claim 1, wherein the cast and optionally cold rolled strip is subjected to a solution treatment at a temperature between 420 and 600° C., quenching and artificial aging at a temperature below 300° C.

6. The process of claim 1, wherein the cast strip is cold rolled to a thickness of less than 2 mm.

* * * * *